United States Patent [19]

Swedenberg et al.

[11] 3,941,632

[45] Mar. 2, 1976

[54] METHOD AND COMPOSITION FOR APPLYING A COVERING TO A WALL OR LIKE SUBSTRATE

[76] Inventors: Clyde J. Swedenberg, 3706 E. North St. Ext., Greenville, S.C. 29607; Charles C. Fain, Bayshore Estates, Clemson, S.C. 29631; William W. Rutledge, 33 W. Tallulah Ave., Greenville, S.C. 29601

[22] Filed: Mar. 17, 1975

[21] Appl. No.: 558,722

Related U.S. Application Data

[62] Division of Ser. No. 175,388, Aug. 26, 1971, Pat. No. 3,887,748.

[52] U.S. Cl. ..... 156/71; 106/111; 156/44; 156/327; 156/333; 156/338; 427/403; 427/407; 427/333; 427/336; 428/140; 428/522; 428/538; 428/906; 428/907

[51] Int. Cl.[2] ..... E04F 13/02

[58] Field of Search ..... 427/333, 336, 207, 403, 427/407; 156/71, 333, 327, 338, 39, 44; 106/111; 428/140, 522, 538, 906, 907

[56] References Cited

UNITED STATES PATENTS

| | | | |
|---|---|---|---|
| 3,383,271 | 5/1968 | Roberts et al. | 156/94 |
| 3,607,486 | 9/1971 | Jacks et al. | 156/44 |

*Primary Examiner*—Edward G. Whitby
*Attorney, Agent, or Firm*—Bailey & Dority

[57] ABSTRACT

Method and composition for applying a surface covering to a wall or like substrate. The surface covering comprises a flexible strip or sheet of substantially dry, semi-hydrated gypsum, bonded to a re-enforcing mesh or lath. The method includes the steps of coating the rear face of the surface covering sheet with aqueous latex adhesive in an amount which will transfer sufficient water from the adhesive to the gypsum to hydrate and set the gypsum, and, at the same time, invert the latex to a tacky, adherent state; and applying the adhesive-coated surface covering to the substrate.

5 Claims, No Drawings

METHOD AND COMPOSITION FOR APPLYING A COVERING TO A WALL OR LIKE SUBSTRATE

This is a division of application Ser. No. 175,388, filed Aug. 26, 1971, now U.S. Pat. No. 3,887,748.

BACKGROUND OF THE INVENTION

U.S. Pat. No. 3,185,297 shows a surface covering or building wall material which includes a semi-hydrated gypsum. A strip of such material is typically applied to a wall or other substrate by spraying or coating sufficient water to a sheet of the material to hydrate the gypsum and cause it to set and harden. While this material can be adequately applied by a skilled worker, the novice or amateur worker frequently has difficulty in gauging the appropriate quantity of water which should be added. Typically, the novice adds a large excess of water which will run into the floor and otherwise create a mess. The extra water causes the gypsum to sag and displace.

SUMMARY OF THE INVENTION

In accordance with the present invention, the amount of water added to the gypsum can be closely controlled and, at the same time, additional adhesive is supplied in a tacky form which will greatly facilitate handling the sheet material and applying it to the substrate. Sagging of the gypsum and dripping of water is eliminated. The surface covering will quickly bond to the substrate without requiring any substantial bonding time.

The surface covering is typically intended for covering an unfinished wall, such as is formed by concrete blocks. The gypsum will desirably be provided on its front face with a re-enforcing mesh or lath which can be given a wallpaper treatment for decorative purposes.

In its semi-hydrated form, the mixture of gypsum and binder is soft and flexible, as is the lath. Accordingly, the surface covering can be furnished in roll form, taking up little space and facilitating handling.

At the site of application, the surface covering is unrolled and a coating of latex adhesive is brushed or rolled onto the rear surface thereof in an amount sufficient to hydrate and set the gypsum and invert the latex. The adhesive coated gypsum sheet is then applied to the substrate.

Other objects, features and advantages of the invention will appear from the following disclosure.

DESCRIPTION OF THE PREFERRED EMBODIMENTS

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

The disclosure of U.S. Pat. No. 3,185,297 is incorporated herein by reference. Said patent discloses a building wall material or surface covering suitable for use in accordance with the present invention. Commercial embodiments of said patent frequently omit the fiber batt 5 of said patent and the lath will typically comprise a fabric mesh on the front face of the gypsum layer, which re-enforces the gypsum and may also constitute an external surface therefor which faces the room to give decorative and wallpaper effects. The covering masks and finishes any rough and unfinished substrate over which the covering is applied, such as concrete block, concrete walls, etc.

As aforestated, the surface covering is typically furnished in roll form inasmuch as the semi-hydrated gypsum-binder is flexible. A sheet or strip of surface covering is unrolled to a desired size and the rear surface thereof is coated with an aqueous latex adhesive in an amount which will transfer sufficient water from the adhesive to the gypsum to hydrate and set the gypsum and, at the same time, remove sufficient water from the adhesive to invert the latex and convert it to a viscous, tacky state, ideally suited to adhere the wall covering firmly to the substrate.

Inasmuch as the entire hydration requirements of the gypsum are supplied by the aqueous latex adhesive, it is unnecessary to supply or otherwise add water to the gypsum. The addition of water is thus closely controlled and all mess and over-hydration is avoided.

There is a wide variety of various latex adhesives that are suitable for use in the present invention. However, a polyvinyl acetate water emulsion has performed admirably because of its ease of formulation, price and ultimate physical properties. Other latex adhesives which are also suitable include: vinyl-acetate-ethylene copolymers, polyvinyl chloride, polymers or copolymers of acrylic acid, acrylonitrile-butadiene copolymers, chlorinated rubber, neoprene, polyisobutylene, SB-R rubber, Butyl rubber.

The polyvinyl acetate in the preferred formulation typically consists of from 45–60% solids, the balance being water.

It is also desirable, but not essential, that a latex plasticizer be included in the adhesive. Suitable plasticizers include: Abalyn, acetyl tributyl citrate, butyl benzyl phthalate, butyl phthalyl butyl glycolate, dibutyl phthalate, dibutyl sebacate, diethyl phthalate, diethylene glycol dibenzoate, diphenyl phthalate, dipropylene gylcol, dipropylene glycol dibenzoate, ethyl phthalyl ethyl glycolate, hexylene glycol, cresyl diphenyl phosphate.

In addition or in lieu of the plasticizer, a latex solvent may be included. Typical suitable solvents include: ethanol, isopropanol, methanol, carbon tetrachloride, chloro-benzene, ethylene dichloride, methylene chloride, perchloro-ethylene, trichloroethylene, ethyl acetate, dioxane, benzene, toluene, xylene, acetone, methyl ethyl ketone, nitrobezene, tetrahydrofuran.

To increase the adhesive characteristic of the coating, a tackifying resin may be included in the formulation. Suitable tackifying resins include: Abalyn, belro, dresinol emulsions, Poly-pale esters, vinsol, Nevillac.

If desired, a thickener can also be added to the formulation. Suitable thickeners include: casein, guargum, gumarabic, hydroxyethylcellulose, methylcellulose, polyvinyl alcohol, starches. Additionally, a fire retardant additive can be included in the formulation. Additives suitable for this purpose include: cresyl diphenyl phosphate, cresyl phenyl phosphate and tricresyl phosphate. A biocide can also be included in the formulation, if desired. Suitable biocides include: phenol, formaldehyde, and santobrite.

Typical general formulations of latex adhesive, by weight, are given in the following examples:

Example I

| | |
|---|---|
| Polyvinyl acetate water emulsion (45% – 60% solids) | 30 – 95 parts |

-continued

| | |
|---|---|
| Plasticizer | 5 – 15 parts |
| Water | 0 – 20 parts |
| Example II | |
| Polyvinyl acetate water emulsion (45% – 60% solids) | 30 – 95 parts |
| Solvent | 5 – 35 parts |
| Water | 0 – 25 parts |
| Example III | |
| Polyvinyl acetate water emulsion (45% – 60% solids) | 30 – 95 parts |
| Plasticizer | 5 – 15 parts |
| Solvent | 0 – 35 parts |
| Water | 0 – 25 parts |
| Example IV | |
| Polyvinyl acetate water emulsion (45% – 60% solids) | 30 – 95 parts |
| Tackifying resin | 1 – 20 parts |
| Water | 0 – 30 parts |
| Example V | |
| Polyvinyl acetate water emulsion (45% – 60% solids) | 30 – 95 parts |
| Thickener | 1 – 20 parts |
| Water | 0 – 30 parts |
| Example VI | |
| Ethylene-vinyl acetate copolymer water emulsion (45% – 60% solids) | 30 – 95 parts |
| Plasticizer | 5 – 15 parts |
| Water | 0 – 20 parts |
| Example VII | |
| Ethylene-vinyl acetate copolymer water emulsion (45% – 60% solids) | 30 – 95 parts |
| Tackifying resin | 1 – 20 parts |
| Water | 0 – 50 parts |

For optimum results, substantially all of the requirements of the gypsum for water should be satisfied by the water present in the adhesive and enough of the water should be removed from the adhesive to invert the latex.

Three parts of water are usually required to set 10 parts of gypsum plaster by weight. Accordingly, if, for example, the gypsum layer of the surface covering has 14 ounces of plaster per square yard 4.2 ounces of water should be supplied in the adhesive per square yard when the adhesive coating is applied. Assuming an adhesive with a real viscosity of 40 poise, 15 square yards of surface covering material is coated with 1 gallon of adhesive. This means that 8.5 ounces of adhesive is applied per square yard of the gypsum. Assuming the adhesive contains 49% water, this will result in a sufficient quantity of water in the adhesive to hydrate and set the plaster. By the same token, an adhesive of 100 poise, which covers 10 square yards per gallon, must have a water content of 34% to completely hydrate and set the gypsum.

Ideally there should be an excess of about 10% water in the adhesive to allow for loss due to evaporation, handling and shipping.

In for foregoing examples, water is present both in the water emulsion and in the additional water component of the formulation.

In the foregoing examples, a sufficient quantity of water has been transferred from the latex emulsion to the gypsum to cause inversion of the latex. Typically, removal of 65 – 75% of the water from a polyvinyl acetate water emulsion adhesive will cause inversion. In the case of polyvinyl acetate, the adhesive will typically change from a white, milky-appearing liquid (5 – 100 poise viscosity) to a clear, semi-solid cabout 100,000 poise viscosity) within a few seconds of application to the gypsum and transfer of water thereto. The effect is the production on the rearface of the wall covering of a continuous film of tacky adhesive somewhat in the nature of a pressure-sensitive film. Prior to coating the gypsum, the adhesive has low viscosity and low tack, thus making it easily-handled and applied. However, within a few seconds after application to the gypsum, the adhesive has the characteristics of a high-viscolsity and highly tacky adhesive. The covering is thus adhered to the substrate substantially instantaneously and with ease and facility by the worker.

We claim:

1. A method of applying to a substrate, a surface covering, comprising a substantially dry, semi-hydrated gypsum, said method comprising the steps of: coating the gypsum with an aqueous latex adhesive in an amount which will transfer sufficient water from the adhesive to the gypsum to hydrate and set the gypsum and invert the latex, and applying the adhesive-coated surface covering to the substrate.

2. The method of claim 1, in which the surface covering further comprises a roll of flexible lath to which the semi-hydrated gypsum is bonded, said roll of surface covering being unrolled into sheet form prior to coating it with the latex adhesive.

3. The method of claim 1, in which said aqueous latex adhesive comprises a polyvinyl acetate water emulsion.

4. The method of claim 1, in which the step of coating the gypsum includes a plasticizer for the latex adhesive.

5. The method of claim 1, in which the step of coating the gypsum includes a solvent for the latex adhesive.

* * * * *